US005851969A

United States Patent [19]

Andrew et al.

[11] Patent Number: 5,851,969

[45] Date of Patent: Dec. 22, 1998

[54] GREASE CONTAINING DIAMINE CORROSION INHIBITORS

[75] Inventors: David Leslie Andrew, Strathroy; Brian Leslie Slack, Sarnia, both of Canada

[73] Assignee: Exxon Research and Engineering Company, Florham Park, N.J.

[21] Appl. No.: 815,018

[22] Filed: Mar. 14, 1997

[51] Int. Cl.[6] ..... C10M 133/06; C10M 133/54

[52] U.S. Cl. ..... 508/556; 508/558

[58] Field of Search ..... 508/556, 558

[56] References Cited

U.S. PATENT DOCUMENTS

| | | | |
|---|---|---|---|
| 3,006,851 | 10/1961 | Loeffler | 508/558 |
| 3,216,939 | 11/1965 | Cyba | 508/556 |
| 3,929,651 | 12/1975 | Murray et al. | 252/41 |
| 3,940,339 | 2/1976 | Clarke, Jr. et al. | 252/18 |
| 4,089,792 | 5/1978 | Lowe | 508/558 |
| 4,162,223 | 7/1979 | Gragson | 508/558 |
| 4,176,075 | 11/1979 | Alexander et al. | 252/42.1 |
| 4,478,604 | 10/1984 | Schuetlenberg | 508/558 |
| 4,795,583 | 1/1989 | Papay | 508/558 |
| 4,935,157 | 6/1990 | Karol | 252/47.5 |
| 4,956,122 | 9/1990 | Watts et al. | 252/565 |
| 5,062,978 | 11/1991 | Weber et al. | 508/558 |
| 5,133,887 | 7/1992 | Terech et al. | 252/33.2 |
| 5,211,860 | 5/1993 | Doner et al. | 252/32.7 |
| 5,368,758 | 11/1994 | Gapinski | 252/42.7 |
| 5,614,481 | 3/1997 | Lopez Rangel | 508/558 |

FOREIGN PATENT DOCUMENTS

| | | | |
|---|---|---|---|
| 06145686 | 5/1927 | Japan | C10M 169/04 |

*Primary Examiner*—Ellen M. McAvoy
*Attorney, Agent, or Firm*—Joseph J. Allocca

[57] ABSTRACT

The present invention is directed to a grease containing base oil, a thickener and a hydrocarbyl substituted diamine additive exhibiting enhanced resistance to corrosion.

9 Claims, No Drawings

GREASE CONTAINING DIAMINE CORROSION INHIBITORS

DESCRIPTION OF THE INVENTION

The present invention is a lubricating grease comprising a major portion of a base oil of lubricating viscosity, a thickener and a minor portion of a diamine additive of the formula

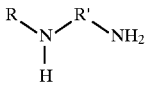

wherein R and R' are the same or different and are $C_1$–$C_{30}$ hydrocarbyl groups. The amount of said diamine additive added to the grease may be in the range 0.01 to 10 wt %. The invention also relates to a method for enhancing the corrosion resistance of greases by incorporating into the grease the diamine additive described above.

DETAILED DESCRIPTION OF THE INVENTION

A grease formulation is disclosed comprising a major portion of a base oil of lubricating viscosity, such base oil being any natural, synthetic or mixture of natural and synthetic oils, a thickener which may be any of the conventional metal soaps and salts such as simple or complex lithium soap thickener, simple or complex calcium soap thickener, mixed lithium and calcium simple or complex soaps, aluminum soaps, urea, di-urea, tri-urea or polyurea thickener, and a minor amount of an additive of the formula

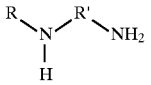

wherein R and R' are the same or different and are $C_1$–$C_{30}$ hydrocarbyl groups. Additional small quantities of other conventional additives may also be included in the grease formulation. Those other additional additives being extreme pressure agents, anti oxidants, dyes, other rust and/or corrosion inhibitors, tackiness agents, oiliness agents, viscosity index improvers, etc.

The lubricating oil base stock that is used in preparing the grease compositions of this invention can be any of the conventionally used mineral oils, synthetic hydrocarbon oils or synthetic ester oils. In general, these lubricating oils will have a viscosity in the range of about 5 to 500 cSt ($mm^2/s$) at 100° C. Minerals lubricating oil base stocks used in preparing the greases can be any conventionally refined base stocks derived from a paraffinic, naphthenic and mixed base crudes. Conventional refinery techniques include distillation, solvent or catalytic dewaxing, solvent extraction, hydrofinishing, hydrocracking, vis-breaking, etc. Synthetic lubricating oils that can be used include esters of di-basic acids, reacted with linear or branched aliphatic alcohols such as $C_6$–$C_{15}$ alcohols, such as di-2-ethylhexyl sebacate, esters of glycols such as $C_{13}$ oxo acid diester or tetraethylene glycol, or complex esters such as one formed from 1 mole of sebacic acid and 2 moles of tetraethylene glycol and 2 moles of 2-ethylhexanoic acid. Other synthetic oils that can be used include synthetic hydrocarbons such as alkyl benzenes, e.g., alkylate bottoms from the alkylation of benzene with tetrpropylene, or the copolymers of ethylene and propylene; silicone oils, e.g., ethyl phenyl polysiloxanes, methyl polysiloxanes, etc.; polyglycol oils, e.g., those obtained by condensing butyl alcohol with propylene oxide; carbonate esters, e.g., the product of reacting $C_6$ oxo alcohol with ethyl carbonate to form a half ester followed by reaction of the latter with tetraethylene glycol, etc. Other suitable synthetic oils include the polyphenyl ethers, e.g., those having from about 3 to 7 ether linkages and about 4 to 8 phenyl groups.

Other suitable oils are the polyol ester oils made by reacting an aliphatic polyol with carboxylic acid. Aliphatic polyols contain from 4 to 15 carbon atoms and has from 2 to 8 esterifiable hydroxyl groups. Examples of polyols are trimethylolpropane, pentaerythritol, dipentaerythritol, neopentyl glycol, tripentaerythiritol and mixtures thereof. The carboxylic acid reactant is selected from aliphatic moncarboxylic acid or mixtures of aliphatic mono carboxylic acids or mixtures of aliphatic mono- and di-carboxylic acids. The carboxylic acids contain 4 to 12 carbons and include straight and branched chain carboxylic acids.

Included in the group of synthetic oils include those recovered from tar sands, shale oil, light hydrocarbons produced via, for example, the Fisher-Tropsch process for converting synthesis gas (CO and hydrogen) into hydrocarbons, wax isomerate oils produced by the catalytic hydroisomerization of natural petroleum waxes (i.e., slack wax) or synthetic waxes (i.e., Fischer-Tropsch waxes) or mixtures of such waxes. See U.S. Pat. No. 5,059,299 and U.S. Pat. No. 5,158,671 for description of wax isomerization and the oils produced thereby. Other synthetic oils include the polyolefins such as polybutene, polyisobutenes and especially the polyalphaolefins, i.e., fluids formed by the olegomerzation of at least one 1-alkane hydrocarbon having from 6 to 20 carbons, preferable 8 to 16 carbons, more preferably 10 to 12 carbons, most preferably 10 carbons. Hydrogenated oligomers are preferred and hydrogenated oligomers formed from 1-decene are particularly preferred.

Thickeners useful in the present grease formulation include simple and complex lithium soaps, preferably complex lithium soaps, simple and complex calcium soaps, mixed lithium-calcium soaps, and polyurea.

Polyurea thickeners are well known in the art. They are produced by reacting an amine or mixture of amines and a polyamine or mixture of polyamines with one or more diisocyanates and one or more isocyanates as appropriate. The reaction can be conducted by combining and reacting the group of reactants, taken from the above list in a reaction vessel at a temperature between about 15° C. to 160° C. for from 0.5 to 5 hours. The reaction is usually accomplished in a solvent, which in the case of grease production, is a quantity of the base oil to be used in the final grease formulation. Detailed discussion of polyurea thickener production for greases can be found in U.S. Pat. No. 4,929,371.

Simple and complex lithium or calcium soaps for use as thickeners in grease formulations and their method of production are also well known to the grease practitioner. Simple soaps are produced by combining one or more fatty acid(s), hydroxy fatty acid(s), or esters thereof in a suitable solvent usually the grease base oil and reacting the acids or esters with the appropriate base, e.g., LiOH or CaOH. Complex lithium or calcium soap thickeners are prepared by combining one or more fatty acid(s), hydroxy fatty acid(s) or esters thereof with an appropriate complexing agent in a suitable solvent, usually the grease base oil and reacting the mixture with the appropriate base, e.g., LiOH or CaOH. The complexing agent typically consists of one or more dicarboxylic acids, or esters thereof, or one or more $C_2$ to $C_6$ short chain carboxylic acids, or esters thereof.

The fatty acid or hydroxy fatty acid used in the production of the thickeners employed in the grease of the present invention has 12 to 24 carbon atoms. Thus lithium or calcium salts of $C_{12}$ to $C_{24}$ fatty acids or of 9-, 10- or 12-hydroxy $C_{12}$ to $C_{24}$ fatty acids or the esters thereof are employed.

The lithium complex soaps are prepared by employing both the $C_{12}$–$C_{24}$ fatty acid, hydroxy fatty acid or esters thereof and a $C_2$–$C_{12}$ dicarboxylic acid complexing agent. Suitable acids, therefore, include the hydroxy stearic acids, e.g., 9-hydroxy, 10-hydroxy or 12-hydroxy stearic acid. Unsaturated fatty or hydroxy fatty acids or esters thereof such as recinolic acid which is an unsaturated form of 12-hydroxy stearic and having a double bond in the 9–10 position, as well as ester of each acid, can also be used. The $C_2$–$C_{12}$ dicarboxylic acids employed will be one or more straight or branched chain $C_2$–$C_{12}$ dicarboxylic acids, preferably $C_4$–$C_{12}$, more preferably $C_6$ to $C_{10}$ dicarboxylic acids or the mono- or di- esters thereof. Suitable examples include oxalic, malonic, succinic, glutaric, adipic, suberic, pimelic, azelaic, dodecanedioic and sebacic acids and the mono- or di- esters thereof. Adipic, sebacic, azelaic acids and mixtures thereof, preferably sebacic and azelaic acids and mixture thereof are employed as the dicarboxylic acids used in the production of the complex lithium soap grease bases.

The calcium complex soaps are prepared by employing the $C_{12}$ to $C_{24}$ fatty acid, hydroxy fatty or ester or glyceride thereof and a $C_2$ to $C_6$ short chain carboxylic acid complexing agent. Suitable acids, therefore, include the hydroxy stearic acids, e.g., 9-hydroxy, 10-hydroxy or 12-hydroxy stearic acid. Unsaturated fatty or hydroxy fatty acids or esters thereof such as recinolic acid which is an unsaturated form of 12-hydroxy stearic and having a double bond in the 9–10 position, as well as ester of each acid, can also be used. The short chain carboxylic acid can be straight chain or branched, preferably $C_2$ to $C_6$, and more preferably $C_2$, $C_3$ or $C_4$. Examples of short chain carboxylic acids include acetic acid, propanoic acid, butanoic acid, etc. Acetic acid is the preferred complexing acid in the production of calcium complex greases. Acetic acid can be added to the grease formulation in the form of the free acid and then neutralized with CaOH along with the fatty acid, fatty acid ester or fatty acid glyceride, or alternatively, calcium acetate can be added to the grease directly.

Neutralization of the simple acid type soap (simple soap) or different acid-type acid mixture (complex soap) with the base is usually conducted at a temperature in the range of about 180°to 220° F. When the soap has thickened to a heavy consistency the temperature is raised to about 290°–310° F. to ensure elimination of water. Subsequent heating to a high temperature of about 380°–420° F. followed by addition of the balance of the oil used in preparing the grease and cooling to about 220° F. can also be practiced.

While it is expected that the skilled practitioner of grease production will be familiar with the technique used to produce complex lithium or calcium greases, various of such production methods are presented in detail in U.S. Pat. No. 3,681,242, U.S. Pat. No. 3,791,973, U.S. Pat. No. 3,929,651, U.S. Pat. No. 5,236,607, U.S. Pat. No. 4,582,619, U.S. Pat. No. 4,435,299, U.S. Pat. No. 4,787,992. Mixed lithium-calcium soap thickened greases are described in U.S. Pat. No. 5,236,607, U.S. Pat. No. 5,472,626. The particular techniques used to produce the simple or complex lithium or calcium soaps or lithium-calcium soaps are not believed to be critical in the present invention and do not form part of the present invention. The above is offered solely as illustration and not limitation.

In the present invention the preferred thickener, regardless of the technique used for its production, is complex lithium soap.

The grease formulation of the present invention contains anywhere from 1 to 30 wt % thickener, preferably 5 to 15 wt % thickener, based on the finished formulation.

A preferred complex lithium grease base is disclosed and claimed in U.S. Pat. No. 3,929,651 which also teaches a detailed procedure for its production. The teachings of that patent are incorporated herein by reference. Broadly that complex lithium grease base comprises a major amount of a base oil, a minor amount of a complex lithium soap thickener and a minor quantity of a lithium salt of a $C_3$–$C_{14}$ hydroxy carboxylic acid where in the OH group is attached to a carbon atom that is not more than 6 carbon atoms removed from the carbon of the carboxyl group.

In U.S. Pat. No. 3,929,651, the complex lithium soap is any of the conventional complex lithium soaps of the literature and typically comprises a combination of a dilithium salt of a $C_2$–$C_{12}$ dicarboxylic acid or the mono- or di-ester of such acids and a lithium salt of a $C_{12}$–$C_{24}$ fatty acid or of a 9-, 10- or 12-hydroxy $C_{12}$–$C_{24}$ fatty acid or the ester of such acid. These materials have been discussed in detail above. In addition, the grease also contains an additional lithium salt component, the lithium salt of a hydroxy carboxylic acid (s) or ester(s) thereof having an OH group attached to a carbon atom that is not more than 6 carbons removed from the carbon of the carboxyl group. This acid has from 3 to 14 carbon atoms and can be either an aliphatic acid such as lactic acid, 6-hydroxydecanoic acid, 3-hydroxybutanoic acid, 4-hydroxybutanoic acid, 6-hydroxy-alpha-hydroxy-stearic acid, etc., or an aromatic acid such as parahydroxybenzoic acid, salicylic acid, 2-hydroxy-4-hexylbenzoic acid, metahydroxybenzoic acid, 2,5-dihydroxybenzoic acid (gentisic acid); 2,6-dihydroxybenzoic acid (gamma resorcyclic acid); 2-hydroxy-4-methoxybenzoic acid, etc., or a hydroxyaromatic aliphatic acid such as 2-(ortho hydroxphenyl)-, 2-(meta hydroxyphenyl)-, or 2-(parahydroxyphenyl)-ethanoic acid. A cycloaliphatic hydroxy acid such as hydroxycyclopentyl carboxylic acid or hydroxynaphthenic acid could also be used. Particularly useful hydroxy acids (or the esters thereof) are 2-hydroxy-4-methoxybenzoic acid, salicylic acid, and parahydroxybenzoic acid. Instead of using the free hydroxy acid of the latter type when preparing the grease, one can use a lower alcohol ester, e.g., the methyl, ethyl, or propyl, isopropyl, or secbutyl ester of the acid, e.g., methyl salicylate. The ester of the hydroxy carboxylic acid is hydrolyzed with aqueous lithium hydroxoide to give the lithium salt. The monolithium salt or the dilithium salt of the $C_3$–$C_{14}$ hydroxy acid or ester thereof can be used, but the dilithium salt is preferred.

As taught in U.S. Pat. No. 3,929,651, these three component lithium salt thickeners can be formed in a number of different ways. One convenient way when the $C_3$–$C_{14}$ hydroxy carboxylic acid is salicylic acid is to co-neutralize the $C_{12}$–$C_{24}$ fatty acid or 9-, 10-, or 12- hydroxy $C_{12}$–$C_{24}$ fatty acid and the dicarboxylic acid in at least a portion of the oil with lithium hydroxide. This neutralization will take place at a temperature in the range of about 180° F. to 220° F. When the soap stock has thickened to a heavy consistency, the temperature is raised to about 260° F. to 300° F., to bring about dehydration. The soap stock is then cooled to about 190° F. to 210° F., and the additional acid or ester of the $C_3$–$C_{14}$ hydroxy carboxylic acid, e.g., methyl salicylate is added; then, additional lithium hydroxide is added gradually to convert the acid or ester, e.g., salicylate, to the dilithium acid or ester e.g., salicylate, salt. Reaction is conducted at about 220° F. to 240° F., preferably with agitation so as to facilitate the reaction. In this reaction, the alcohol is evolved, and dilithium acid or ester, e.g., salicylate, salt forms.

Dehydration is then completed at 300° F. to 320° F., after which the grease is heated at 380°–390° F. for 15 minutes to improve its yield and is then cooled while additional oil is added to obtain the desired consistency. Alternatively, the additional oil can be added to the soap concentrate prior to the in situ formation of the dilithium salt of the appropriate acid or ester, e.g., the dilithium salt of salicylic acid.

An alternative method is to co-neutralize all three types of acid used in making the grease, or to saponify a lower ester of the hydroxy $C_3$–$C_{14}$ acid, e.g., methyl salicylate, simultaneously with the neutralization of the hydroxy fatty acid of the first type, e.g., hydroxystearic acid and the dcarboxylic acid. Still another alternative is to co-neutralize the hydroxy fatty acid and the ester of the hydroxy $C_3$–$C_{14}$ acid followed by neutralization of the dicarboxylic acid.

The greases contain, based on the finished grease mass, from about 2 to about 35 wt % and preferably about 10 to about 25 wt % of all three lithium salt components. The additional lithium salt of the $C_3$–$C_{14}$ hydroxycarboxylic acid (e.g., dilithium salicylate) is present in the grease in an amount in the range 0.05 to 10 wt % of the finished grease. The proportion of the lithium soap of $C_{12}$–$C_{24}$ fatty acid or 9-, 10- or 12- hydroxy $C_{12}$–$C_{24}$ fatty acid to the lithium soap of the dicarboxylic acid can be in the range of 0.5 to 15 parts by weight of the former to one part by weight of the latter, preferably in the range of 1.5 to 5 parts by weight of the soap of the $C_{12}$–$C_{24}$ fatty acid or 9-,10- or 12- hydroxy $C_{12}$–$C_{24}$ fatty acid to one part by weight of the soap of the dicarboxylic acid. The proportion of the $C_3$–$C_{14}$ hydroxy carboxylic acid to the dicarboxylic acid will be from about 0.025 to 2.5 parts by weight of the hydroxy carboxylic acid to one part by weight of the dicarboxylic acid, preferably about 0.125 to 1.25 parts by weight of the hydroxy carboxylic acid to one part by weight of the dicarboxylic acid.

A preferred complex lithium grease base useful in the present member comprises a major amount of a base oil, a minor amount of the three component lithium salt thickeners described in the U.S. Pat. No. 3,929,651, discussed immediately above and thiadiazole. This particular grease is disclosed and claimed in copending application U.S. Pat. No. 712,066 filed Sep. 11, 1996 in the name of David L Andrew.

The thiadiazol type materials used in that formulation are the general formula:

$$R_1—(S)_x—Q—(S)_y—R_2 \quad (1)$$

wherein Q is a 1,3,4-thiadiazole, 1,2,4-thiadiazole, 1,2,3-thiadiazole or a 1,2,5-thiadiazole heterocycle, "x" and "y" may be the same or different and are integers from 1 to 5 and $R_1$ and $R_2$ are the same or different and are H or $C_1$–$C_{50}$ hydrocarbyl, or (2)

$$R_1—(S)_x—Q_1—(S)_z—Q_2—(S)_y—R_2 \quad (2)$$

wherein $Q_1$ and Q2 are the same or different and are 1,3,4-thiadiazole, 1,2,4-thiadiazole, 1,2,3-thiadiazole or 1,2,5-thiadiazole heterocycles, "x", "y", and "z" may be the same or different and are integers of from 1 to 5, and $R_1$ and $R_2$ are the same or different and are H or $C_1$–$C_{50}$ hydrocarbyl. The preferred thiadiazole has the structure 2 where x=1, y=1 and z=2, $R_1$=hydrogen, $R_2$=hydrogen and $Q_1$=$Q_2$ and is 1,3,4-thiadiazole. The preferred thiadiazole is available from R. T. Vanderbilt Company, Inc., under the trade name Vanlube 829.

In the preferred grease the thiadiazole material is present in the grease in an amount in the range 0.05 to 5 wt % of the finished grease. The thiadiazole material is added to the grease in U.S. Pat. No. 712,066 for the purpose of enhancing the oxidation resistance of the grease.

The grease formulation of the present invention contain 0.01 to 10 wt %, preferably 0.05 to 5 wt %, more preferably 0.2 to 1.5 wt % of a hydrocarbyl diamine of the formula:

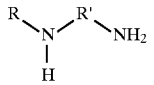

where R and R' are the same or different and are $C_1$–$C_{30}$ straight a branch chain alkyl, alkenyl, alkynyl, aryl substituted aliphatic chains, the aliphatic chains being attached to the nitrogen in the molecule. Preferably R is a $C_{12}$–$C_{18}$ hydrocarbyl moriety, preferably alkyl or alkenyl moiety, and R' is a $C_2$ –$C_6$ hydrocarbyl, preferably alkyl moiety. Preferred hydrocarbyl diamines include those wherein R is a dodecylradical and $R^1$ is a 1,3 propyl diradical (commercially available from Akzo Chemie under the trade name DUOMEEN C); or wherein R=oleyl radical, R'=1,3 propyl diradical (known as DUOMEEN O) or wherein R=tallow radicals, R'=1,3 propyl diradical (known as DUOMEEN T).

Further the grease of the present invention can contain any of the typical grease additives including conventional antioxidants, extreme pressure agents, tackiness agents, dyes, etc. Such typical additives and their functions are described in "Modem Lubricating Greases" by C. J. Bone, Scientific Publication (G. B.) Ltd., 1976.

Examples of antioxidants include the phenolic and aminic type antioxidants and mixture thereof.

The amine type anti-oxidants include diarylamines and thiodiaryl amines. Suitable diarylamines include diphenyl amine; phenyl-α-naphthyl-amine; phenyl-β-naphthylamine; α-α-di-naphthylamine; β-β-dinaphthylamine; or α,β-dinaphthylamine. Also suitable antioxidants are diarylamines wherein one or both of the aryl groups are alkylated, e.g., with linear or branched alkyl groups containing 1 to 12 carbon atoms, such as the diethyl diphenylamines; dioctyldiphenyl amines, methyl phenyl-α-naphthylamines; phenyl-β(butyl-naphthyl) amine; bis(4-methyl phenyl) amine or phenyl (3-propyl phenyl) amine octyl-butyl-diphenylamine, dioctyldiphenyl amine, octyl-, nonyl-diphenyl amine, dinonyl diphenyl amine and mixtures thereof.

Suitable thiodiarylamines include phenothiazine, the alkylated phenothiazines, phenyl thio-α-naphthyl amine; phenyl thio-β-naphthylamine; α-α-thio dinaphthylamine; β-β-thio dinaphthylamine; phenyl thio-α (methyl naphthyl) amine; thio-di (ethyl phenyl) amine; (butyl phenyl) thio phenyl amine.

Other suitable antioxidants include triazines of the formula

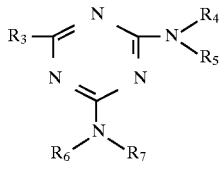

I where $R_4$, $R_5$, $R_6$, $R_7$, are hydrogen, $C_1$ to $C_{20}$ hydrocarbyl or pyridyl, and $R_3$ is $C_1$ to $C_8$ hydrocarbyl, $C_1$ to $C_{20}$ hydrocarbylamine, pyridyl or pyridylamine. If desired mixtures of antioxidants may be present in the lubricant composition of the invention.

Phenolic type anti-oxidants include 2,6-di-t-butyl phenol, 2,6-di-t-butyl alkylated phenol where the alkyl substituent is hydrocarbyl and contains between 1 and 20 carbon atoms, such as 2,6-di-t-butyl-4-methyl phenol, 2,6-di-t-butyl-4-ethyl phenol, etc., or 2,6-di-t-butyl-4-alkoxy phenol where the alkoxy substituent contains between 1 and 20 carbons such as 2,6-di-t-butyl-4-methoxy-phenol; materials of the formula

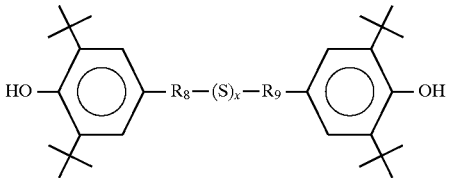

II where X is zero to 5, $R_8$ and $R_9$ are the same or different and are $C_1$–$C_{20}$ hydrocarbyl which may contain oxygen or sulfur or be substituted with oxygen or sulfur containing groups; and materials of the formula

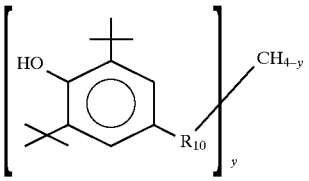

III where y is 1 to 4 and $R_{10}$ is a $C_1$ to $C_{20}$ hydrocarbyl which may contain oxygen or sulfur or be substituted with oxygen or sulfur containing groups, and mixtures of such phenolic type antioxidants.

If present at all the antioxidants, preferably amine type and/or phenolic antioxidants are present in the grease in an amount up to 5 wt % of the finished grease.

The present invention is demonstrated in the following not limiting example and accompanying comparative examples.

EXAMPLES

Six test formulations were prepared, one representative of the formulation of the invention, Example 1, and five comparative formulations, comparative Examples 1–5. Physical characteristics of all formulations and performances in various tests, in particular the EMCOR Rust test run in accordance with IP 220 European Test method, are presented in Table 1 below:

TABLE 1

| | Formulations and Comparative Examples (Comp) | | | | | |
|---|---|---|---|---|---|---|
| COMPONENT | Ex 1 | Comp 1 | Comp 2 | Comp 3 | Comp 4 | Comp 5 |
| PAO Base Oil Mixture | 79.2 | 79.2 | 80.1 | 77.7 | 75.9 | 75.9 |
| Lithium Complex Thickener (12-hydroxystearic acid azelaic acid lithium hydroxide) | 17.2 | 17.2 | 17.3 | 17.4 | 18.7 | 18.7 |
| Antiwear and EP Package | 1.0 | 1.0 | 1.0 | 2.5 | 2.5 | 2.5 |
| Antioxidant | 1.5 | 1.5 | 1.5 | 2.0 | 1.5 | 1.5 |
| Dye | 0.1 | 0.1 | 0.1 | 0 | 0 | 0 |
| Glycerine | | | | 0.41 | 0.44 | 0.44 |
| Rust Inhibitors: | | | | | | |
| NaSul BSN (barium sulfonate) | | 1.00 | | | | |
| DUOMEEN C (N-coco-1,3-diaminopropane) | 1.00 | | | | | |
| NaSul 729 (calcium sulfonate) | | | | | 1.00 | |
| Nasul 707 (lithium sulfonate) | | | | | | 1.00 |
| TESTS | | | | | | |
| Base oil viscosity @ 40° C. in cSt (ASTM D445) | 104.9 | 104.9 | 104.9 | 461.5 | 461.5 | 461.5 |
| Base oil viscosity @ 100° C. in cSt (ASTM D445) | 14.6 | 14.6 | 14.6 | 47.5 | 47.5 | 47.5 |
| Base oil Viscosity Index (ASTM D2270) | 143 | 143 | 143 | 161 | 161 | 161 |
| 6O stroke penetration in mm/10 (ASTM D217) | 276 | 293 | 281 | 306 | 315 | 310 |
| 100,000 stroke penetration in mm/10 (ASTM D217) | 298 | 304 | 294 | | | |
| Softening in 60 stroke pen caused by the Rust Inhibitor | −5 | +12 | +12 | | | |
| Dropping point in °C. (ASTM D2265) | 264 | 233 | 246 | | | |
| Water washout in wt % (ASTM D1264) | 7.4 | 12.5 | 5.0 | | | |
| 4-ball wear scar in mm (ASTM D2266) | 0.40 | 0.37 | 0.37 | | | |
| EMCOR rust test with 10% synthetic sea water (IP220) | 0,0 | 1,2 | 2,2 | 3,3 | 2,2 | 1,2 |

Table 2 presents the key to the EMCOR Rust Test Rating Scale referred to in Table 1.

TABLE 2

EMCOR Rust Test Rating Scale

| EMCOR Rust Test Result | Description |
|---|---|
| 0 | No rust |
| 1 | 3 or fewer small corrosion spots, each sufficient to be visible to the naked eye |
| 2 | Small areas of corrosion covering less than 1% of the bearing area |
| 3 | Between 1% and 5% of bearing area corroded |
| 4 | Between 5% and 10% of bearing area corroded |
| 5 | More than 10% of bearing area corroded |

The same sample of base grease was used to prepare formulations Ex 1, Comp 1, and Comp 2 described in Table 1. Formulation Comp 2 did not contain any supplementary rust inhibitor while formulations Comp 1 and Example 1 contained barium sulfonate and DUOMEEN C respectively. Barium sulfonate (NaSul BSN) is frequently used as a rust inhibitor in lithium grease formulations at the 1% treat level. The EMCOR test data in Table 1 demonstrate that DUOMEEN C is much more effective than barium sulfonate in preventing corrosion in salt water conditions. The data in Table 1 also demonstrate that DUOMEEN C does not have any negative impact on other grease properties such as dropping point, water resistance, anti-wear performance, and consistency stability. In fact, DUOMEEN C has the added benefit of not causing additive softening problems. Additive softening problems are usually associated with conventional sulfonate based rust inhibitors. Moreover, DUOMEEN C is ashless and does not contain any metals (e.g., barium) which may be considered to have undesirable environmental effects.

Table 1 also contains formulations based on calcium and lithium sulfonates (Comp 4 and Comp 5). Formulations Comp 4 and Comp 5 contain the same type of base grease as that used in Comp 3. Formulation Comp 3 was not treated with any supplementary rust inhibitor. A comparison of the EMCOR test results obtained for Comp 4 and Comp 5 with the test results obtained for Comp 3 demonstrates that complete salt water rust protection can not be achieved by adding 1 wt % of a calcium or lithium sulfonate (NaSul 729 or NaSul 707) to a lithium grease. This is to be compared against Example 1 which achieved a zero EMCOR Rust Test rating (no rust) and does not negatively impact other grease performance characteristics.

What is claimed is:

1. A lubricating grease comprising a major portion of a base oil of lubricating viscosity and a minor portion of additives comprising a thickener and a diamine of the formula

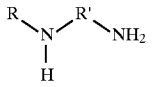

wherein R and R' are the same or different and are $C_1$–$C_{30}$ hydrocarbyl group and the thickener is simple or complex lithium soap, simple or complex calcium soap, mixed lithium and calcium simple or complex soaps, aluminum soaps, urea, di-urea, tri-urea or polyurea.

2. The grease of claim 1 wherein the lease oil of lubricating viscosity is selected from natural or synthetic base oils.

3. The grease of claim 1 wherein the base oil of lubricating viscosity is poly-alpha olefin.

4. The grease of claim 1 wherein the thickener is simple or complex lithium soap, simple or complex calcium soap, mixed lithium and calcium simple soap, or mixed lithium and calcium complex soap.

5. The grease of claim 1 containing from 1 to 30 wt % thickener.

6. The grease of claim 1 containing 0.01 to 10 wt % of the diamine.

7. A method for improving the corrosion resistance of greases thickened using simple or complex lithium soap, simple or complex calcium soap, mixed lithium and calcium simple or complex soaps, aluminum soaps, urea, di-urea, tri-urea or polyurea thickener comprising adding to the grease about 0.01 to 10 wt % of a diamine of the formula

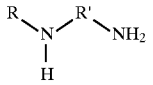

wherein R and R' are the same or different and are $C_1$ to $C_{30}$ hydrocarbyl.

8. The method of claim 7 wherein the grease is based on a base oil of lubricating viscosity selected from natural or synthetic base oils.

9. The method of claim 7 wherein the grease contains 1–10 wt % thickener.

* * * * *